US008550023B1

(12) United States Patent
Quail

(10) Patent No.: US 8,550,023 B1
(45) Date of Patent: Oct. 8, 2013

(54) RETRACTABLE ANCHORING POLE

(76) Inventor: Richard Quail, Pinellas Park, FL (US)

( * ) Notice: Subject to any disclaimer, the term of this patent is extended or adjusted under 35 U.S.C. 154(b) by 310 days.

(21) Appl. No.: 12/932,377

(22) Filed: Feb. 24, 2011

Related U.S. Application Data

(60) Provisional application No. 61/307,926, filed on Feb. 25, 2010.

(51) Int. Cl.
*B63B 21/24* (2006.01)
*B63B 21/26* (2006.01)

(52) U.S. Cl.
USPC ..... 114/294; 114/230.13; 114/295

(58) Field of Classification Search
USPC ..... 114/230.1, 230.13–230.17, 293–295; 52/155; 37/345, 346
See application file for complete search history.

(56) References Cited

U.S. PATENT DOCUMENTS

| | | | | |
|---|---|---|---|---|
| 3,656,449 | A * | 4/1972 | Mead | 440/36 |
| 3,902,448 | A * | 9/1975 | Davis | 37/346 |
| 6,041,730 | A * | 3/2000 | Oliverio et al. | 114/294 |
| 7,971,548 | B2 * | 7/2011 | Kuenzel | 114/294 |
| 2011/0209652 | A1 * | 9/2011 | Bernloehr et al. | 114/230.13 |

* cited by examiner

*Primary Examiner* — Ajay Vasudeva

(57) ABSTRACT

A power anchor having a boat mount, a hydraulic cylinder, a pivoting assembly, comprising a proximal pivot, a distal pivot, and a pivot link. There is also provided an anchor shaft, having a tapered point.

8 Claims, 8 Drawing Sheets

RETRACTABLE ANCHORING POLE

RELATED APPLICATIONS

The Applicant bases this utility application on a previously filed Provisional Application, bearing Ser. No. 61/307,926, filed on Feb. 25, 2010, and currently pending. The Applicant claims the priority of the herein referenced application The Applicant has not submitted a related pending or patented non-provisional application within two months of the filing date of this present application. The invention is made by a single inventor, so there are no other inventors to be disclosed. This application is not under assignment to any other person or entity at this time.

BACKGROUND OF THE INVENTION

1. Field of the Invention

The present invention relates to a retractable anchoring pole and more particularly pertains to a mechanical device for anchoring a boat in shallow water.

2. Description of the Prior Art

The use of mechanical devices for anchoring a boat is known in the prior art. More specifically, mechanical devices for anchoring a boat previously devised and utilized for the purpose of anchoring in shallow water are known to consist basically of familiar, expected, and obvious structural configurations, notwithstanding the designs encompassed by the prior art, which has been developed for the fulfillment of countless objectives and requirements.

While the prior art devices fulfill their respective, particular objectives and requirements, the prior art does not describe a retractable anchoring pole that allows a user to mechanically anchor a boat in shallow water.

In this respect, the retractable anchoring pole, according to the present invention, substantially departs from the conventional concepts and designs of the prior art, and in doing so provides an apparatus primarily developed for the purpose of easily and safely anchoring a boat in shallow water.

Therefore, it can be appreciated that there exists a continuing need for a new and improved retractable anchoring pole which can be used for anchoring a boat in shallow water. In this regard, the present invention substantially fulfills this need.

SUMMARY OF THE INVENTION

In view of the foregoing disadvantages inherent in the known types of mechanical devices for anchoring a boat now present in the prior art, the present invention provides an improved retractable anchoring pole. As such, the general purpose of the present invention, which will be described subsequently in greater detail, is to provide a new and improved retractable anchoring pole which has all the advantages of the prior art and none of the disadvantages.

To attain this, the present invention essentially comprises a retractable anchoring pole comprising several components, in combination.

First, there is a boat mount. The boat mount is fabricated of a rigid material. The mount has a generally rectilinear configuration, with a forward boat contacting proximal surface and a rearward distal mounting surface.

The boat mount has a plurality of mounting apertures there through. The boat mount has a rearward extension coupled to the rearward distal mounting surface. The rearward extension has a generally rectilinear configuration, with a proximal end being coupled to the boat mount distal mounting surface. The extension has a distal end having a mounting slot therein. The mounting slot has a generally C-shaped distal extension end, with two parallel mounting tabs. Each of the extension mounting tabs has a pair of pin holes there through, being an upper extension cylinder pin hole and a lower extension arm pin hole. The boat mount extension has an upper extension mounting pin and a lower extension mounting pin, associated therewith.

Next is hydraulic cylinder. The hydraulic cylinder has an upper ram and a lower ram. The hydraulic cylinder body has a lower end and an upper end. The lower end of the lower ram has a generally rectilinear configuration with a mounting pin hole there through. The mounting pin hole is configured to receive the upper mounting pin of the mount extension. The hydraulic cylinder has a generally round hollow tubular body. The cylinder body has an exterior surface and an interior surface, forming a cylinder cavity therein. The cylinder body has a wall thickness between the exterior surface and the interior surface. The cylinder body has a two directional ram piston located withing the interior surface. The ram piston has a lower surface, with an associated lower surface connecting rod. The ram piston has an upper surface, with an associated upper surface connecting rod.

The ram body has a pair of hydraulic line connectors coupled there to, with each of the connectors forming a fluid passageway through the cylinder body thickness to allow hydraulic fluid to enter the interior of the cylinder body. The lower piston surface connecting rod is coupled to the lower surface of the ram piston. The upper piston connecting rod is coupled to the upper surface of the ram piston. The upper piston connecting rod has an uppermost extent, with the uppermost extent of the upper piston connecting rod having an associated rod coupling.

Next is a ram extension shaft. The ram extension shaft has a generally rounded tubular configuration with an external diameter. The ram extension shaft has an distal end and a proximal end with a length there between. The proximal end is configured to mate with, and be attached to, the rod coupling of the hydraulic ram. The distal end of the ram extension shaft has an extension shaft bolt hole there through.

Next is a lower boat mount extension arm. The boat mount extension arm has a lower portion and an upper portion. The lower portion has a generally rectilinear configuration and is generally planar and oriented in a generally horizontal plane. The upper extension arm portion has a generally rectilinear configuration and is generally planar. The upper arm portion of the extension arm has a length. The upper extension arm portion is oriented in a generally vertical plane.

The lower extension arm portion has a lower pin hole there through. The lower pin hole is configured to accept the lower extension mounting pin, thereby rotatably coupling the lower portion of the extension arm to the rearward slot of the boat mount extension. The upper extension arm portion has a pin hole there through. The upper extension arm pin hole is generally parallel to the lower extension arm pin hole.

Next there is an extension tube lock. The extension tube lock is fabricated of rigid material and has a generally rectilinear configuration, with an upper surface, a lower surface, and a thickness there between. The thickness forms a peripheral edge there around. The tube lock has a forward end and a rearward end. The tube lock has a sleeve hole there through. The tube lock has a slot there in. The slot and the sleeve hole each run from the upper surface to the lower surface. The forward end of the tube lock has four fixing pin holes there in. The rearward end of the tube lock has a pin hole there through.

The extension tube lock has a plurality of associated tube lock pins. The tube lock pins operatively couple the upper portion of the boat mount extension arm to the rearward end of the tube lock. The tube lock has a plurality of tube lock fixing pins which are configured to be mated with, and be received by, each of the four fixing pin holes of the forward end of the tube lock.

Next is an extension sleeve. The extension sleeve is fabricated of a rigid material. The extension sleeve has an outer surface, having an external diameter, and an inner surface, having an internal diameter. There is a wall thickness there between.

The extension sleeve has a proximal end and a distal end. The extension sleeve has a hollow tubular configuration, forming an inner passageway there through. The proximal end of the extension sleeve is configured and sized to be fixedly contained within the rounded aperture of the tube lock. The extension sleeve is fixed with the insertion of the plurality of fixing pins of the tube lock. The proximal end of the extension sleeve is coupled to the hydraulic cylinder.

The distal end of the extension sleeve has a plurality of sleeve fixing pin holes there through. The extension sleeve has an insert associated there with. The insert has an external diameter. The insert has a flange, with a shaft passageway there through. The external diameter of the insert is sized to fit within the internal diameter of the extension sleeve. The shaft passageway is sized to be larger than the external diameter of the ram extension shaft.

The insert has a plurality of fixing pins associated there with. The fixing pins are each sized to fit through the fixing pin holes of the distal end of the extension sleeve. The insert flange is sized to be less than the external diameter of the extension sleeve, and more than the internal diameter of the extension sleeve.

Next is a proximal pivot. The proximal pivot is fabricated of rigid material. The proximal pivot has a generally rectilinear body having a rounded sleeve recess therein. The round sleeve recess is configured to receive and mate with the external diameter of the distal extension sleeve. The rounded recess of the proximal pivot has a lower opening and an upper terminus. The upper terminus has a rounded shaft hole there through.

The proximal pivot assembly has a pair of rearwardly oriented tabs forming a generally C-shaped link recess there between. The link recess is formed by a left tab and a right tab. There is a space between the tabs. Each of the proximal pivot tabs have a bolt hole there through. There is a bolt configured to pass through the bolt holes of the proximal pivot tabs.

The body of the proximal pivot has a plurality of fixing pin holes there through, with there being a plurality of body fixing pins associated there with.

Next is a pivot assembly link. The pivot assembly link is fabricated of rigid material. The link has a proximal portion and a distal portion. The proximal portion has a length with a lower end. The lower end of the length of the proximal portion has a bolt hole there through. The lower end of the length of the proximal portion has an associated bolt. The bolt operatively couples the link and the tabs of the proximal pivot. The distal portion of the pivot assembly link having a generally tapered configuration with a flattened end portion. The flattened end portion of the distal portion of the link has a bolt hole there through.

Next is a distal pivot. The distal pivot is fabricated of a rigid material. The distal pivot has a proximal forward end and a distal rearward end with a length there between. The distal pivot has an upper surface and a lower surface, with a thickness there between. The lower surface of the proximal end of the distal pivot has an stepped recess therein. The stepped recess has a link portion and a shaft portion. The link portion of the recess has a first depth, with the first depth being less than the thickness of the distal pivot.

The shaft portion of the stepped recess has a second depth. The second depth is greater than the first depth. The link portion recess has a link bolt hole therein. The link bolt hole has an associated bolt. The associated link bolt rotatably coupes the link portion of the recess and the distal portion of the pivot assembly link. The shaft portion of the recess having a second depth with the second depth being less than the thickness of the distal pivot and greater than the first depth.

The shaft portion of the distal pivot has a shaft bolt hole there through and an associated shaft bolt. The associated shaft bolt rotatably couples the shaft portion of the recess and the distal end of the ram extension shaft. The distal end of the distal pivot has an anchor shaft hole there through. The anchor shaft hole has a locking bolt hole passing there through. The distal end of the distal pivot has an associated anchor locking bolt.

Lastly, there is an anchor shaft. The anchor shaft has a generally round tubular configuration. The anchor shaft is fabricated from a material from the group of materials which includes metals, wood, plastics, and fiberglass. The anchor shaft has a proximal end and a distal end, with a length there between. The proximal end is sized to be snugly received by the distal end of the distal pivot. The proximal end of the anchor shaft has an anchor locking bolt hole there through. The proximal end of the anchor shaft is operatively coupled in the anchor shaft hole of the distal end of the distal pivot. The distal end of the anchor shaft has a tapered point.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved retractable anchoring pole which has all of the advantages of the prior art mechanical devices for anchoring a boat and none of the disadvantages.

It is another object of the present invention to provide a new and improved retractable anchoring pole which may be easily and efficiently manufactured and marketed.

It is further object of the present invention to provide a new and improved retractable anchoring pole which is of durable and reliable constructions.

An even further object of the present invention is to provide a new and improved retractable anchoring pole which is susceptible of a low cost of manufacture with regard to both materials and labor, and which accordingly is then susceptible of low prices of sale to the consuming public, thereby making such retractable anchoring pole economically available to the buying public.

Even still another object of the present invention is to provide a retractable anchoring pole for anchoring a boat in shallow water.

Lastly, it is an object of the present invention to provide a new and improved power anchor having a boat mount, a hydraulic cylinder, a pivoting assembly, comprising a proximal pivot, a distal pivot, and a pivot link. There is also provided an anchor shaft, having a tapered point.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
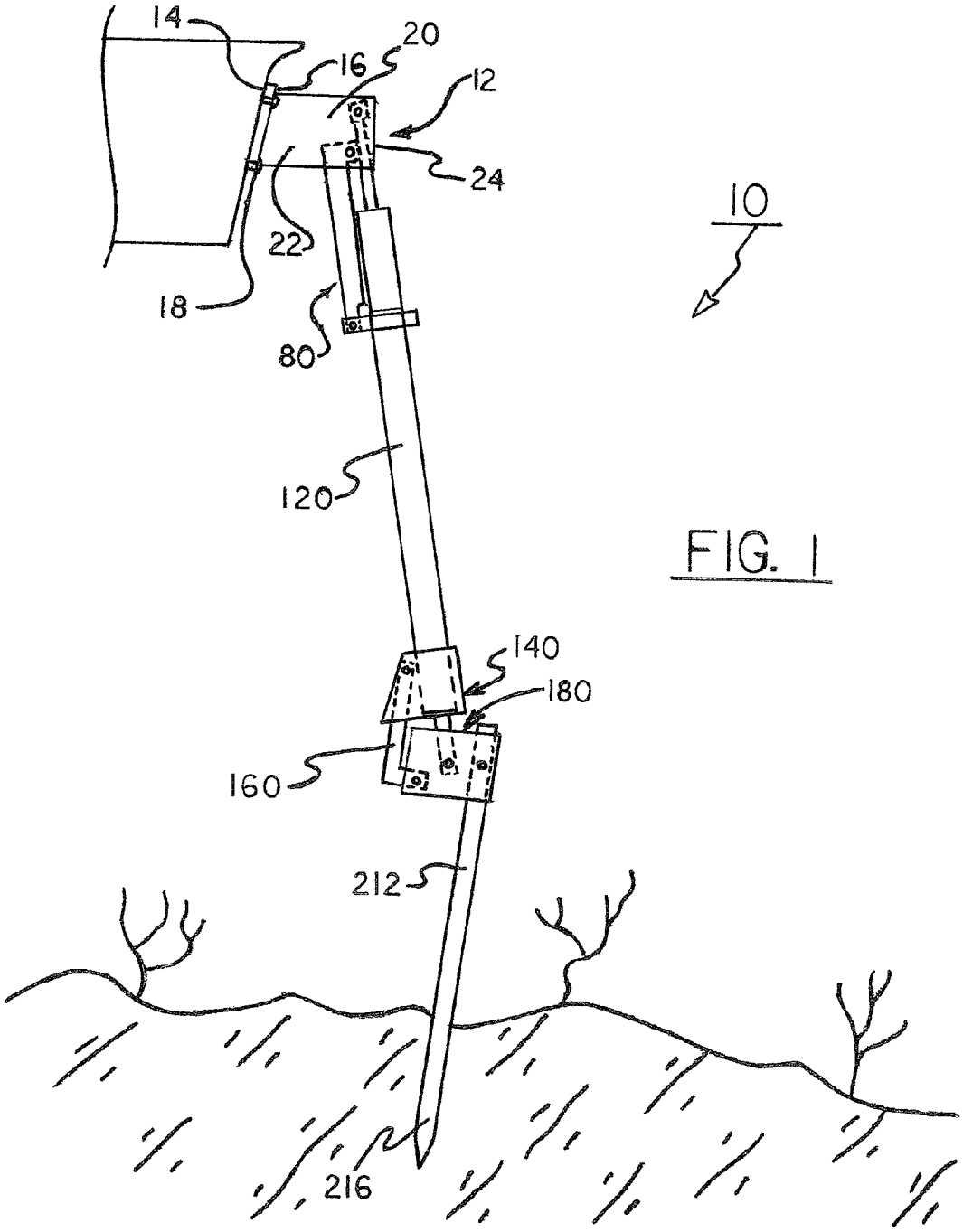
FIG. 1 is a side elevational view of the retractable anchoring pole in the deployed orientation. Note that the distal end of the anchor contacts the seabed and holds the boat from drifting with the current.
Figure 2:
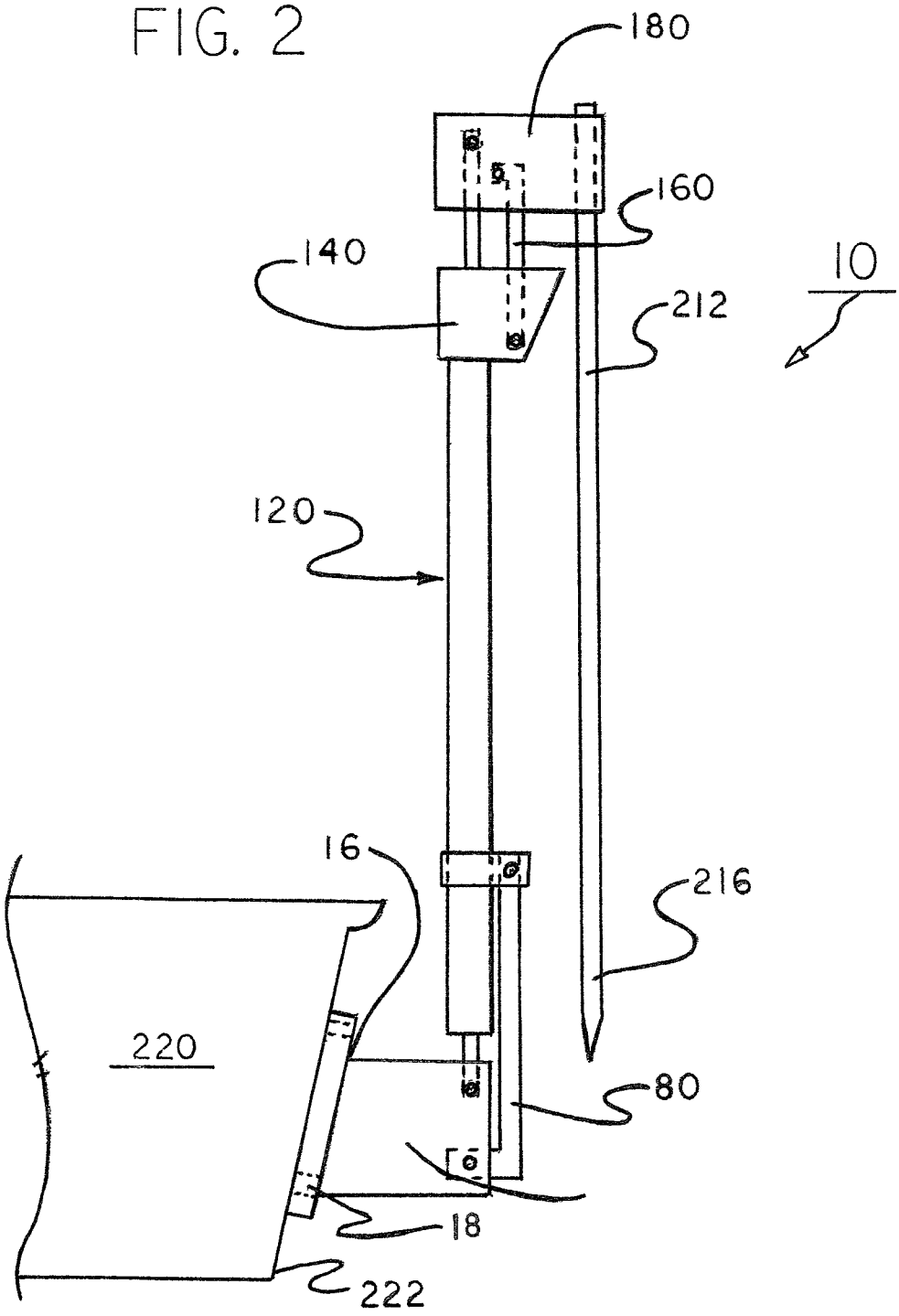
FIG. 2 is a side elevational view of the retractable anchoring pole in the stored orientation. Note that the distal end of the anchor is drawn up, allowing the boat to move unencumbered by the anchor.
Figure 3:
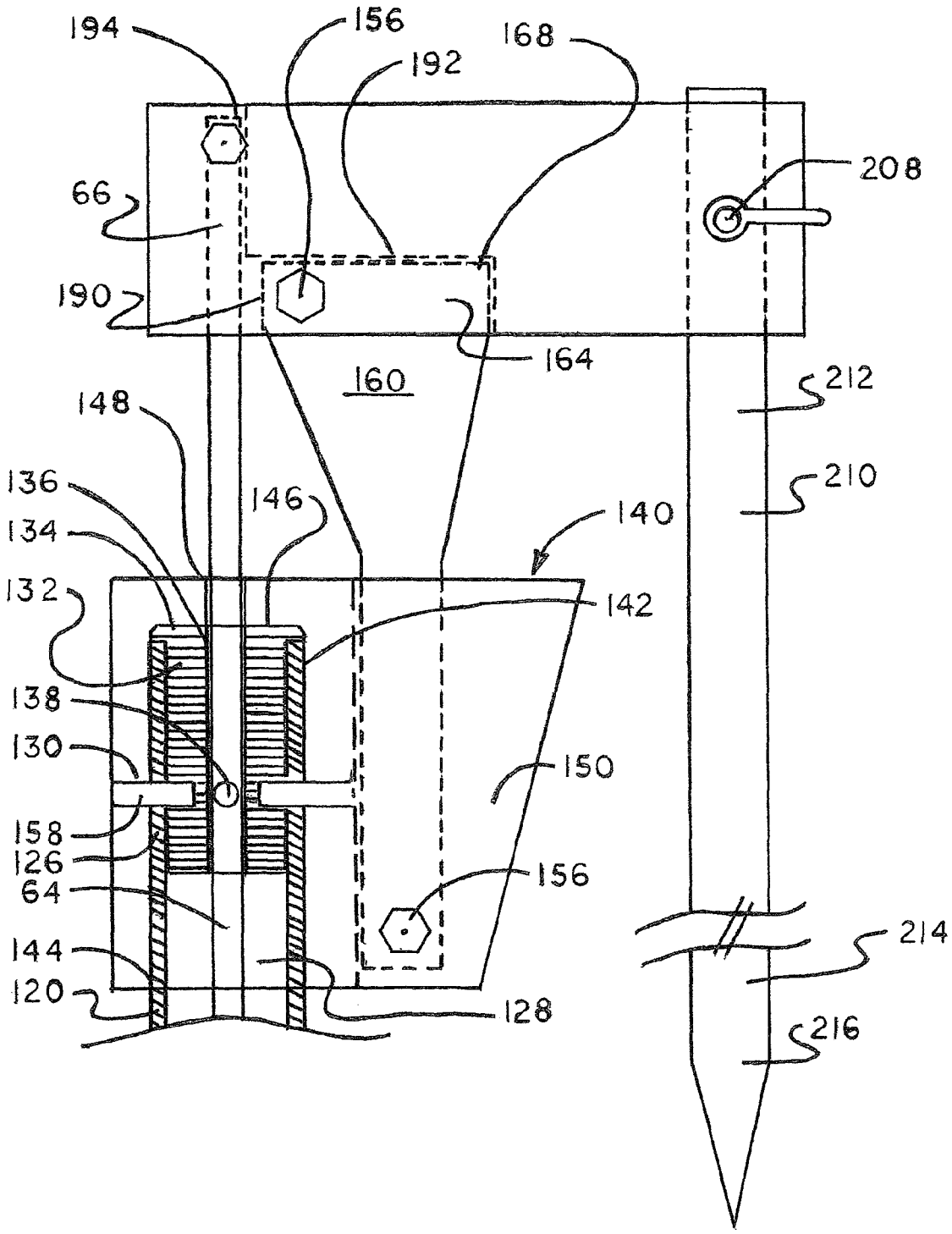
FIG. 3 is close-up view of the proximal pivot, distal pivot, and link. The stepped recess is shown in phantom. Note the cross sectional view of the extension sleeve and extension sleeve insert.
Figure 4:
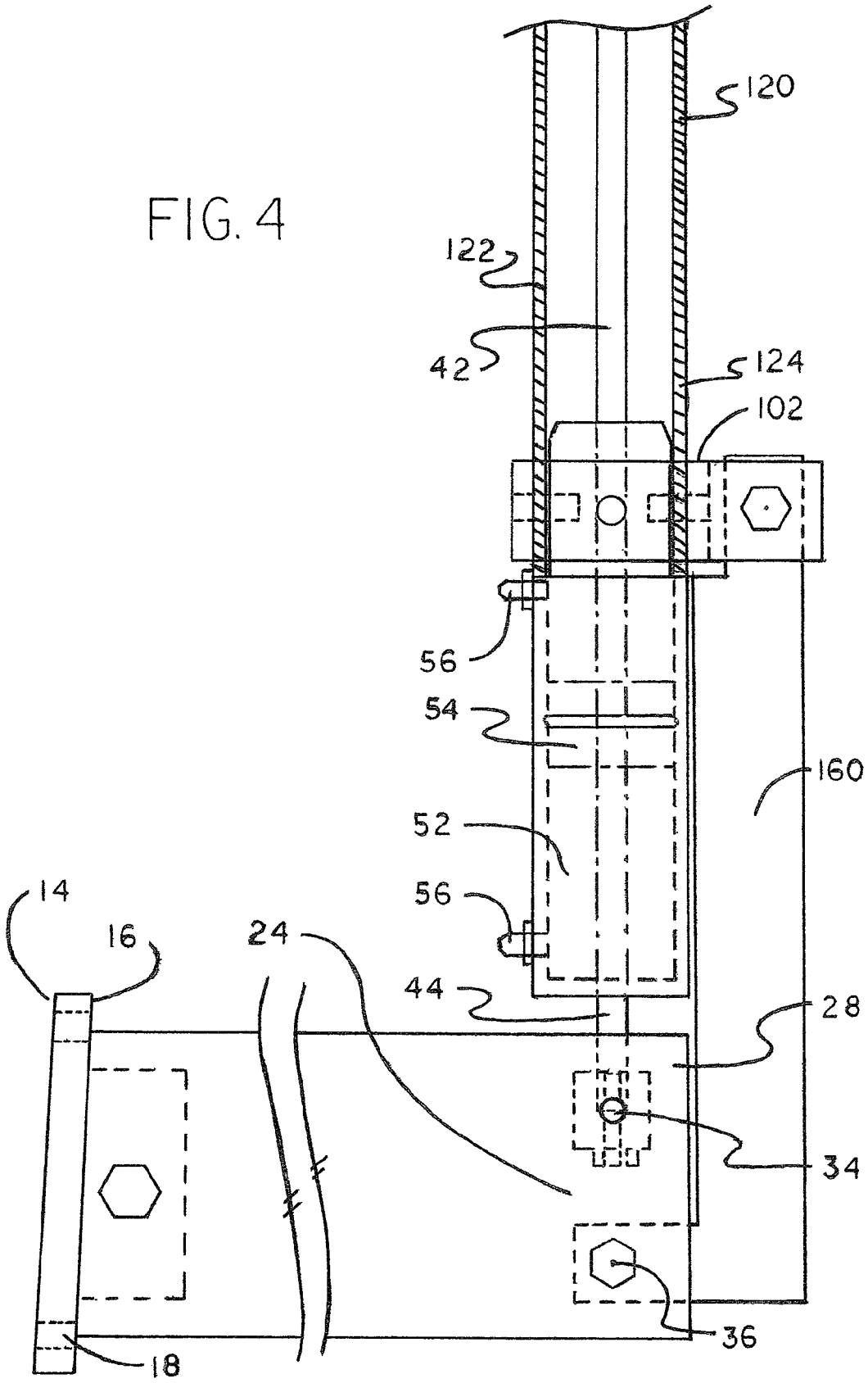
FIG. 4 is close-up view of the mount, mount extension, mount extension arm, and hydraulic cylinder. The extension sleeve is shown in cross section, so as to demonstrate the relationship of the hydraulic cylinder, extension sleeve, and extension tube lock.
Figure 5:
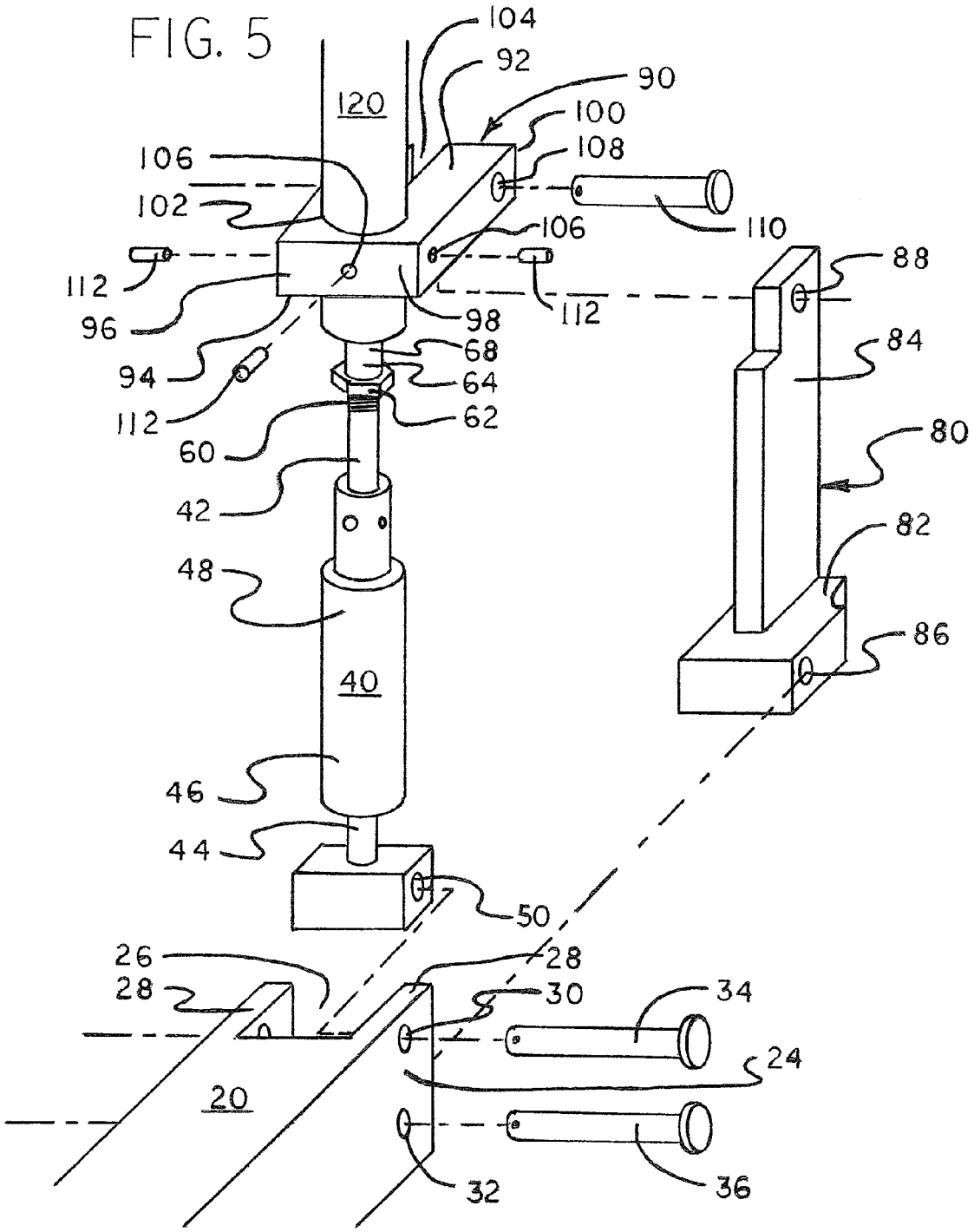
FIG. 5 is an exploded perspective view of the mount extension, extension arm, hydraulic cylinder and extension tube lock.
Figure 6:
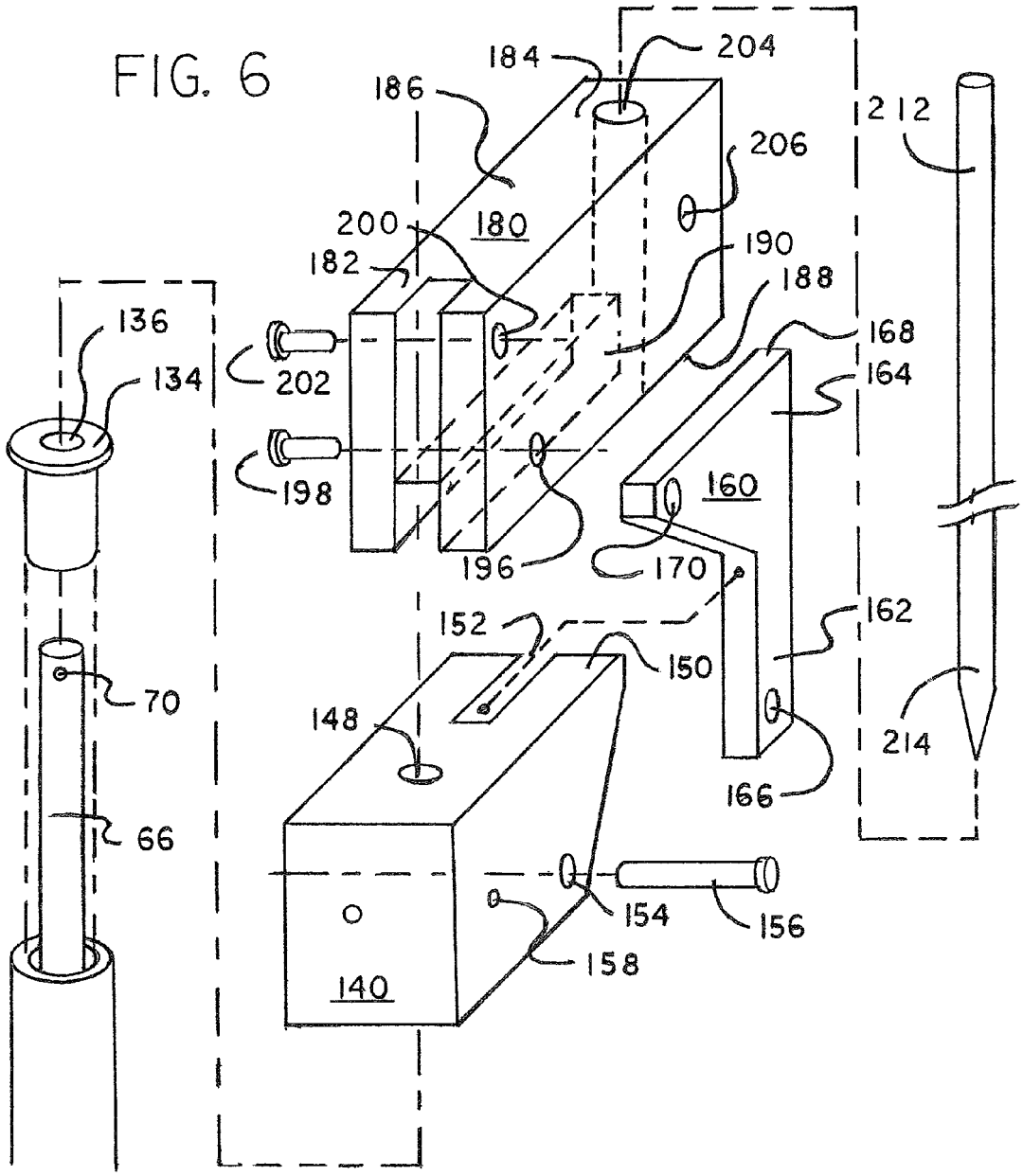
FIG. 6 is an exploded perspective view of the proximal pivot, distal pivot, and link. Note the extension sleeve and extension sleeve insert.

With reference now to the drawings, and in particular to FIG. 1 thereof, the preferred embodiment of the new and improved RETRACTABLE ANCHORING POLE embodying the principles and concepts of the present invention and generally designated by the reference numeral 10 will be described.

The present invention, the retractable anchoring pole 10 is comprised of a plurality of components. Such components in their broadest context include a mount, a hydraulic cylinder, a proximal and distal pivot and an anchoring pole. Such components are individually configured and correlated with respect to each other so as to attain the desired objective.

A retractable anchoring pole comprising several components, in combination is herein described.

First, there is a boat mount 12. The boat mount is fabricated of a rigid material. The mount has a generally rectilinear configuration, with a forward boat contacting proximal surface 14 and a rearward distal mounting surface 16.

The boat mount has a plurality of mounting apertures 18 there through. The boat mount has a rearward extension 20 coupled to the rearward distal mounting surface. The rearward extension has a generally rectilinear configuration, with a proximal end 22 being coupled to the boat mount distal mounting surface. The extension has a distal end 24 having a mounting slot 26 therein. The mounting slot has a generally C-shaped distal extension end, with two parallel mounting tabs 28. Each of the extension mounting tabs has a pair of pin holes there through, being an upper extension cylinder pin hole 30 and a lower extension arm pin hole 32. The boat mount extension has an upper extension mounting pin 34 and a lower extension mounting pin 36, associated therewith.

Next is a two directional hydraulic cylinder 40. The hydraulic cylinder has an upper ram 42 and a lower ram 44. The hydraulic cylinder body has a lower end 46 and an upper end 48. The lower end of the lower ram has a generally rectilinear configuration with a mounting pin hole 50 there through. The mounting pin hole is configured to receive the upper mounting pin of the mount extension. The hydraulic cylinder has a generally round hollow tubular body 52. The cylinder body has an exterior surface and an interior surface, forming a cylinder cavity therein (not shown, but well known in the art). The cylinder body has a wall thickness between the exterior surface and the interior surface. The cylinder body has a two directional ram piston 54 located withing the interior surface. The ram piston has a lower surface, with an associated lower surface connecting rod. The ram piston has an upper surface, with an associated upper surface connecting rod.

The ram body has a pair of hydraulic line connectors 56 coupled there to, with each of the connectors forming a fluid passageway through the cylinder body thickness to allow hydraulic fluid to enter the interior of the cylinder body. The lower piston surface connecting rod is coupled to the lower surface of the ram piston. The upper piston connecting rod is coupled to the upper surface of the ram piston. The upper piston connecting rod has an uppermost extent 60, with the uppermost extent of the upper piston connecting rod having an associated rod coupling 62.

Next is a ram extension shaft 64. The ram extension shaft has a generally rounded tubular configuration with an external diameter. The ram extension shaft has an distal end 66 and a proximal end 68 with a length there between. The proximal end is configured to mate with, and be attached to, the rod coupling of the hydraulic ram. The distal end of the ram extension shaft has an extension shaft bolt hole 70 there through.

Next is a lower boat mount extension arm 80. The boat mount extension arm has a lower portion 82 and an upper portion 84. The lower portion has a generally rectilinear configuration and is generally planar and oriented in a generally horizontal plane. The upper extension arm portion has a generally rectilinear configuration and is generally planar. The upper arm portion of the extension arm has a length. The upper extension arm portion is oriented in a generally vertical plane.

The lower extension arm portion has a lower pin hole 86 there through. The lower pin hole is configured to accept the lower extension mounting pin, thereby rotatably coupling the lower portion of the extension arm to the rearward slot of the boat mount extension. The upper extension arm portion has a pin hole 88 there through. The upper extension arm pin hole is generally parallel to the lower extension arm pin hole.

Next there is an extension tube lock 90. The extension tube lock is fabricated of rigid material and has a generally rectilinear configuration, with an upper surface 92, a lower surface 94, and a thickness there between. The thickness forms a peripheral edge 96 there around. The tube lock has a forward end 98 and a rearward end 100. The tube lock has a sleeve hole 102 there through. The tube lock has a slot 104 there in. The slot and the sleeve hole each run from the upper surface to the lower surface. The forward end of the tube lock has four fixing pin holes 106 there in. The rearward end of the tube lock has a pin hole 108 there through.

The extension tube lock has an associated arm lock pins 110. The arm lock pin operatively couples the upper portion of the boat mount extension arm to the rearward end of the tube lock. The tube lock has a plurality of tube lock fixing pins 112 which are configured to be mated with, and be received by, each of the four fixing pin holes of the forward end of the tube lock.

Next is an extension sleeve 120. The extension sleeve is fabricated of a rigid material. The extension sleeve has an outer surface 122, having an external diameter, and an inner surface, having an internal diameter. There is a wall thickness there between.

The extension sleeve has a proximal end 124 and a distal end 126. The extension sleeve has a hollow tubular configuration, forming an inner passageway 128 there through. The proximal end of the extension sleeve is configured and sized to be fixedly contained within the rounded aperture of the tube lock. The extension sleeve is fixed with the insertion of the plurality of fixing pins of the tube lock. The proximal end of the extension sleeve is coupled to the hydraulic cylinder.

The distal end of the extension sleeve has a plurality of sleeve fixing pin holes 130 there through. The extension sleeve has an insert 132 associated there with. The insert has an external diameter. The insert has a flange 134, with a shaft passageway 136 there through.

The external diameter of the insert is sized to fit within the internal diameter of the extension sleeve. The shaft passageway is sized to be larger than the external diameter of the ram extension shaft.

The insert has a plurality of fixing pins 138 associated there with. The fixing pins are each sized to fit through the fixing pin holes of the distal end of the extension sleeve. The insert flange is sized to be less than the external diameter of the extension sleeve, and more than the internal diameter of the extension sleeve.

Next is a proximal pivot 140. The proximal pivot is fabricated of rigid material. The proximal pivot has a generally rectilinear body having a rounded sleeve recess 142 therein. The round sleeve recess is configured to receive and mate with the external diameter of the distal extension sleeve. The rounded recess of the proximal pivot has a lower opening 144 and an upper terminus 146. The upper terminus has a rounded shaft hole 148 there through.

The proximal pivot assembly has a pair of rearwardly oriented tabs 150 forming a generally C-shaped link recess 152 there between. The link recess is formed by a left tab and a right tab. There is a space between the tabs. Each of the proximal pivot tabs have a bolt hole 154 there through. There is a bolt 156 configured to pass through the bolt holes of the proximal pivot tabs.

The body of the proximal pivot has a plurality of fixing pin holes 158 there through, with there being a plurality of body fixing pins (not shown) associated there with.

Next is a pivot assembly link 160. The pivot assembly link is fabricated of rigid material. The link has a proximal portion 162 and a distal portion 164. The proximal portion has a length with a lower end. The lower end of the length of the proximal portion has a bolt hole 166 there through. The lower end of the length of the proximal portion has an associated bolt 156. The bolt operatively couples the link and the tabs of the proximal pivot. The distal portion of the pivot assembly link having a generally tapered configuration with a flattened end portion 168. The flattened end portion of the distal portion of the link has a bolt hole 170 there through.

Next is a distal pivot 180. The distal pivot is fabricated of a rigid material. The distal pivot has a proximal forward end 182 and a distal rearward end 184 with a length there between. The distal pivot has an upper surface 186 and a lower surface 188, with a thickness there between. The lower surface of the proximal end of the distal pivot has an stepped recess 190 therein. The stepped recess has a link portion 192 and a shaft portion 194. The link portion of the recess has a first depth, with the first depth being less than the thickness of the distal pivot.

The shaft portion of the stepped recess has a second depth. The second depth is greater than the first depth. The link portion recess has a link bolt hole 196 therein. The link bolt hole has an associated bolt 198. The associated link bolt rotatably coupes the link portion of the recess and the distal portion of the pivot assembly link. The shaft portion of the recess having a second depth with the second depth being less than the thickness of the distal pivot and greater than the first depth.

The shaft portion of the distal pivot has a shaft bolt hole 200 there through and an associated shaft bolt 202. The associated shaft bolt rotatably couples the shaft portion of the recess and the distal end of the ram extension shaft. The distal end of the distal pivot has an anchor shaft hole 204 there through. The anchor shaft hole has a locking bolt hole 206 passing there through. The distal end of the distal pivot has an associated anchor locking bolt 208.

Lastly, there is an anchor shaft 210. The anchor shaft has a generally round tubular configuration. The anchor shaft is fabricated from a material from the group of materials which includes metals, wood, plastics, and fiberglass. The anchor shaft has a proximal end 212 and a distal end 214, with a length there between. The proximal end is sized to be snugly received by the distal end of the distal pivot. The proximal end of the anchor shaft is operatively coupled in the anchor shaft hole of the distal end of the distal pivot. The distal end of the anchor shaft has a tapered point 216.

Figure 7:
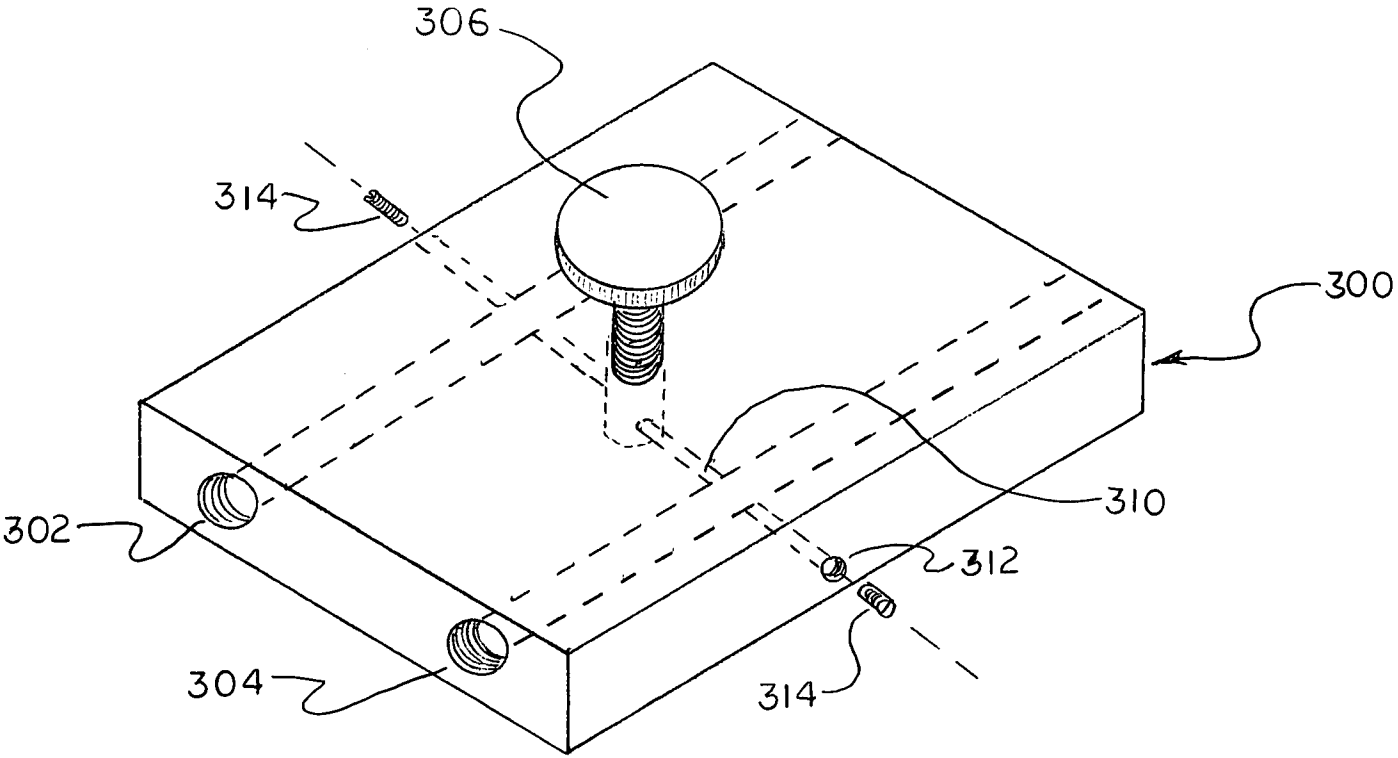
FIG. 7 is a perspective view of the hydraulic bypass, for allowing the hydraulic cylinder to be extended or retracted without use of power. The threaded bolt, with knurled top, is threaded into the passageway, or threaded out of the passageway, depending if the user wants the hydraulic fluid to bypass the operating valve (not shown).
Figure 8:
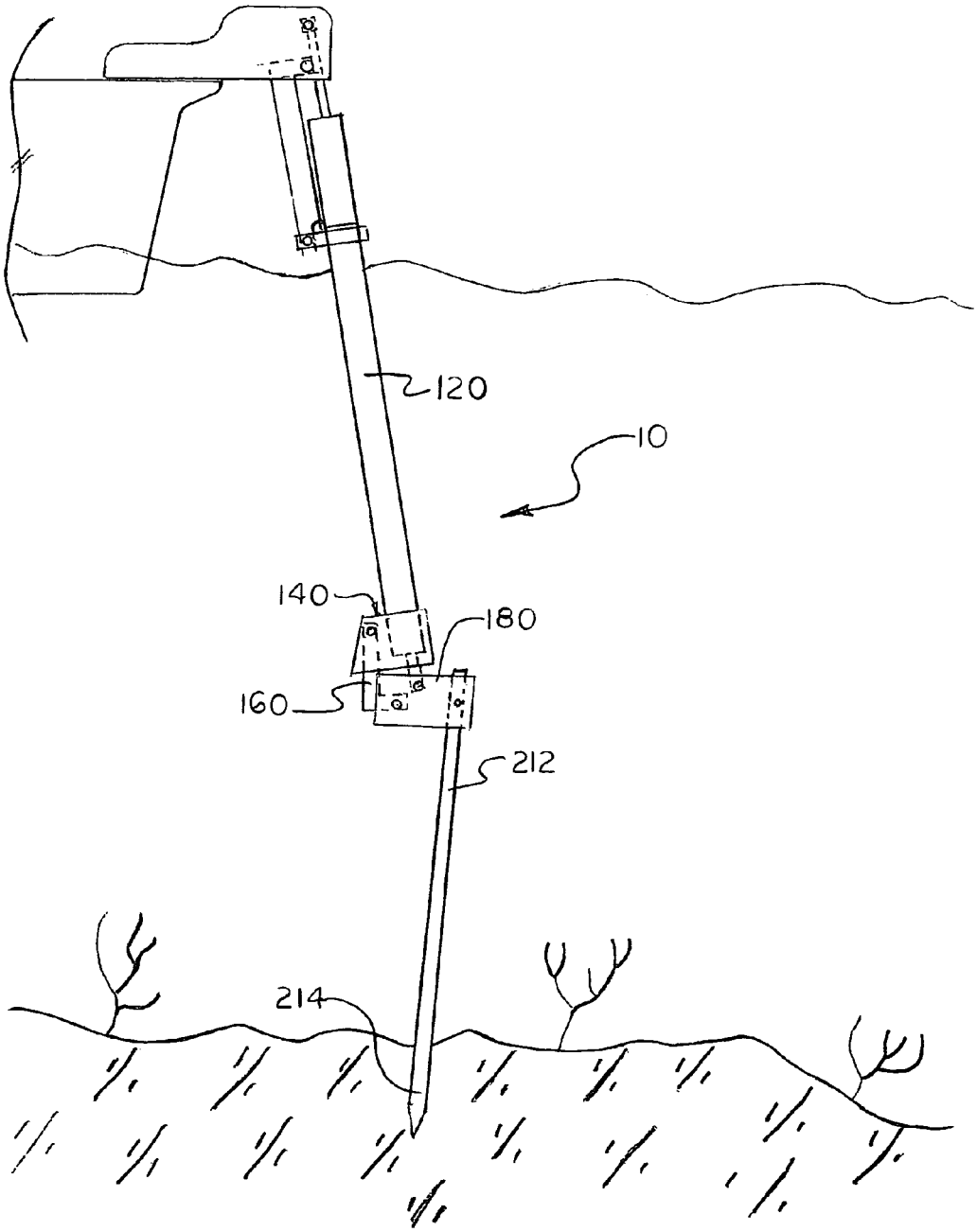
FIG. 8 is a side elevational view of the retractable anchoring pole mounted on a boat topside, which allows the retractable anchoring pole to be attached at a boat bow location.

In operation, a boat 220 has a stern 222, to which the retractable anchor is coupled. Not shown, but well known in the art, is a power source, a hydraulic pump, and a valve control, so as to allow the passage of hydraulic fluid into and out of the cylinder cavity, forcing the piston in one or another direction. A problem, which may occur, is a failure of the pump, valve, or power source, which does not allow the user to change the position of the retractable anchor. FIG. 7, which shows a bypass fluid pathway 300, is positioned (Tee'd into)

the fluid pathway, between the feed 302 and return 304 to the hydraulic cylinder. If the fluid pathway of the bypass is opened, as occurs with the unthreading of the knurled bolt from the fluid pathway, then the hydraulic fluid can pass from the feed line to the pump, to the return line to the reservoir, effectively bypassing the power source, pump, and control valve. If a pump, power source, or valve fails, the user can turn the knurled bolt 306, which unblocks the fluid pathway, allowing the hydraulic fluid to move through the system, without the use of the pump, power source, or valve. If the knurled bolt is threaded into the pathway, and blocks the pathway, the hydraulic system operates in a normal mode, using the power source, pump, and control valve. This allows the user to move the retractable anchor, without using power, pump, or control valve. Additionally, as with the present art, the user does not have to take apart anything in the anchor, to effectuate any movement, but can do so by only turning the knurled bolt, and then moving the anchor by hand.

In order to make the connecting passageways, a cross passageway 310 is drilled in the block, and the access hole 312, which is threaded, is then plugged 314, so as to close off the passageway from the access hole As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A retractable anchoring pole comprising, in combination:

a boat mount having a forward boat contacting proximal surface and a rearward distal mounting surface;

a hydraulic cylinder having an upper ram and a lower ram, the hydraulic cylinder having a lower end and an upper end, the lower ram of the hydraulic cylinder being coupled to the boat mount;

a ram extension shaft having a generally rounded tubular configuration with an external diameter, the ram extension shaft having an distal end and a proximal end with a length there between, the proximal end being configured to mate with and be coupled to the upper hydraulic ram;

a boat mount extension arm having a lower portion and an upper portion with a length there between, the lower portion of the boat mount extension arm being coupled to the rearward distal mounting surface of the boat mount;

an extension tube lock with an upper surface and a lower surface and a thickness there between, the thickness forming a peripheral edge there around, the tube lock having a forward end and a rearward end, the tube lock having a sleeve hole there through and the tube lock having a slot there through, the extension tube lock being coupled to the upper portion of the boat mount extension arm;

an extension sleeve having an outer surface having an external diameter, and an inner surface having an internal diameter with a wall thickness there between, the extension sleeve having a proximal end and a distal end, the extension sleeve proximal end being coupled to the tube lock;

a proximal pivot having a generally rectilinear body having a generally round sleeve recess therein, the sleeve recess being configured to receive and mate with the external diameter of the distal end of the extension sleeve, the proximal pivot being coupled to the extension sleeve, the proximal pivot having a pair of tabs;

a pivot link having a proximal portion and a distal portion, the proximal portion having a length with a lower end, the pivot link being coupled to the proximal pivot;

a distal pivot having a proximal forward end and a distal rearward end with a length there between, the distal pivot being coupled to the pivot link and the distal end of the ram extension shaft; and an anchor shaft having a generally round tubular configuration, the shaft anchor being coupled to the distal pivot.

2. The retractable anchoring pole as described in claim 1 with the anchoring pole further comprising:

the boat mount having a rearward extension coupled to the rearward distal mounting surface;

the extension tube lock having a plurality of fixing pin holes therein, with the tube lock having a plurality of associated fixing pins;

the extension sleeve having a hollow tubular configuration forming an inner passageway there through;

the proximal pivot recess having a lower opening and an upper terminus, the upper terminus having a generally rounded shaft hole there through;

the pivot link having an associated bolt, with the bolt operatively coupling the pivot link and the tabs of the proximal pivot;

the distal pivot having an upper surface and a lower surface with a thickness there between; and the anchor shaft having a proximal end and a distal end with a length there between, the proximal end of the anchor shaft being coupled to the distal end of the distal pivot.

3. The retractable anchoring pole as described in claim 2 with the anchoring pole further comprising:

the boat mount rearward extension having a generally rectilinear configuration with a proximal end being coupled to the boat mount distal mounting surface, the extension having a distal end having a mounting slot therein;

the hydraulic cylinder having a generally round hollow tubular body, the cylinder body having an exterior surface and an interior surface forming a ram cavity therein, the cylinder body having a wall thickness between the exterior surface and the interior surface;

the ram extension shaft distal end having an extension shaft bolt hole there through;

the boat mount extension arm lower portion having a lower pin hole there through;

the tube lock sleeve hole and slot forming a pair of passageways through the tube lock, the sleeve passageway having a generally rounded configuration and the slot having a linear configuration, the passageways each running from the upper surface of the tube lock to the lower surface of the tube lock;

the extension sleeve proximal end being configured and sized to be fixedly contained within the round sleeve portion of the tube lock passageway;

the proximal pivot rearwardly oriented tabs forming a generally C-shaped link recess there between, the link recess being formed by a left tab and a right tab, with a space there between;

the pivot link proximal portion lower end having a bolt hole there through; and the distal pivot lower surface proximal end having a stepped recess therein, the stepped recess having a link portion and a shaft portion, the link portion of the recess having a first depth with the first depth being less than the thickness of the distal pivot, the shaft portion of the recess having a second depth with the second depth being greater than the first depth.

4. The retractable anchoring pole as described in claim 3 with the anchoring pole further comprising:

the boat mount mounting slot having forming a generally C shaped distal extension end with two parallel mounting tabs;

the cylinder body having a two directional ram piston located within the interior surface, the ram piston having a lower surface with an associated lower surface connecting rod, the ram piston having an upper surface with an associated upper surface connecting rod;

the tube lock forward end having four fixing pin holes there in, the rearward end of the tube lock having an arm pin hole there through;

the extension sleeve proximal end being associated with the upper end of the hydraulic ram, the distal end of the extension sleeve having a plurality of sleeve tube lock fixing pins holes there through;

the proximal pivot tabs each have a bolt hole there through, with there being a bolt configured to pass through the bolt holes of the proximal pivot tabs;

the pivot link proximal portion lower end having an associated bolt; and the distal pivot link portion recess having an link bolt hole therein, the link bolt hole having an associated bolt, with the associated link bolt rotatably coupling the link portion of the recess and the distal portion of the pivot link.

5. The retractable anchoring pole as described in claim 4 with the anchoring pole further comprising:

each of the boat mount extension mounting tabs having a pair of pin holes there through;

the lower piston surface connecting rod being coupled with the lower ram piston surface, the upper piston connecting rod being coupled with the upper ram piston surface, the upper piston connecting rod having an upper most extent;

the extension sleeve having an insert associated there with, the insert having an external diameter and a flange and a shaft passageway there through;

the proximal pivot body having a plurality of fixing pin holes there through, with a plurality of body fixing pins associated there with;

the pivot link distal portion having a generally tapered configuration with a flattened end portion, the flattened end portion of the distal portion of the link having a bolt hole there through;

the distal pivot shaft portion recess being through the thickness of the distal pivot, the shaft portion recess of the distal pivot having a shaft bolt hole there through and an associated shaft bolt, with the associated shaft bolt rotatably coupling the shaft portion of the recess and the distal end of the ram extension shaft; and the anchor shaft proximal end having an anchor locking bolt hole there through, with the proximal end of the anchor shaft being operatively coupled in the anchor shaft hole of the distal end of the distal pivot assembly.

6. The retractable anchoring pole as described in claim 5 with the anchoring pole further comprising:

the boat mount pin holes comprising an upper extension pin hole, being a ram mounting pin hole, and a lower extension pin hole;

the upper most extent of the upper piston connecting rod having an associated rod coupling;

the boat mount extension arm lower portion having a generally rectilinear configuration being generally planar and being oriented in a generally horizontal plane, the upper extension arm portion having a generally rectilinear configuration being generally planar, the upper extension arm portion being oriented in a generally vertical plane;

the tube lock pin operatively coupling the upper portion of the boat mount extension arm to the rearward end of the tube lock; and the distal pivot distal end having an anchor shaft hole there through, the anchor shaft hole having a locking bolt hole passing there through.

7. The retractable anchoring pole as described in claim 6 with the anchoring pole further comprising:

the boat mount extension having an upper extension mounting pin associated there with and a lower extension mounting pin associated therewith, the boat mount extension mounting pin hole being configured to receive the upper mounting pin of the mount extension and the boat mount extension lower extension pin hole being configured to receive the lower mounting pin;

the boat mount extension arm lower pin hole being configured to accept the lower extension mounting pin, thereby rotatably coupling the lower portion of the extension arm to the rearward slot of the boat mount extension, the upper extension arm portion having a pin hole there through;

the extension tube lock having a generally rectilinear configuration;

the extension sleeve insert external diameter being sized to fit within the internal diameter of the extension sleeve, the shaft passageway being sized to be larger than the external diameter of the ram extension shaft, the insert having a plurality of fixing pin holes therein and a plurality of fixing pins associated there with, the insert fixing pins being sized to fix the distal end of the extension sleeve and the extension sleeve insert;

the distal pivot distal end having an associated anchor locking bolt; and the anchor shaft distal end having a tapered point.

8. The retractable anchoring pole as described in claim 7 with the anchoring pole further comprising:

the boat mount fabricated of a rigid material having a plurality of mounting apertures there through, the boat mount having a generally rectilinear configuration;

the cylinder body having a pair of hydraulic line connectors coupled there to, with each of the connectors forming a fluid passageway through the cylinder body thickness to allow hydraulic fluid to enter the interior of the cylinder body;

the boat mount extension arm upper extension arm pin hole being generally parallel to the lower extension arm pin hole;

the extension tube lock being fabricated of rigid material;

the tube lock having a plurality of tube lock fixing pins which are configured to be mated with and received by each of the four fixing pin holes of the forward end of the tube lock;

the extension sleeve being fabrica-41 of rigid material with the extension sleeve being fixed to the tube lock with the insertion of the plurality of fixing pns of the tube lock, the insert flange being sized to be less thau the external diameter of the extension sleeve and more than the internal diameter of the extension sleeve, the insert having fixing pin holes therein;

the proximal pivot being fabricated of rigid material;

the pivot link being fabricated of rigid material;

the distal pivot being fabricated of a rigid material; and the anchor shaft being made from a member of the group of materials which includes metals and plastics and fiberglass.

* * * * *